US005487373A

United States Patent [19]

Smith

[11] Patent Number: 5,487,373

[45] Date of Patent: Jan. 30, 1996

[54] ARCHERY BOW WITH LATERALLY ADJUSTABLE LIMB POCKET

[75] Inventor: Allan F. Smith, Tucson, Ariz.

[73] Assignee: Precision Shooting Equipment, Inc., Tucson, Ariz.

[21] Appl. No.: 294,927

[22] Filed: Aug. 24, 1994

[51] Int. Cl.[6] ..... F41B 5/00

[52] U.S. Cl. ..... 124/23.1; 124/88

[58] Field of Search ..... 124/23.1, 24.1, 124/25.6, 86, 88, 900

[56] References Cited

U.S. PATENT DOCUMENTS

| | | | |
|---|---|---|---|
| 4,674,468 | 6/1987 | Izuta | 124/88 X |
| 5,172,679 | 12/1992 | Mussack | 124/25.6 |
| 5,241,945 | 9/1993 | Shepley | 124/88 |
| 5,280,779 | 1/1994 | Smith | 124/88 |
| 5,339,790 | 8/1994 | Smith | 124/25.6 |
| 5,411,008 | 5/1995 | Hsu | 124/23.1 |

*Primary Examiner*—John A. Ricci
*Attorney, Agent, or Firm*—Cahill, Sutton & Thomas

[57] ABSTRACT

In an archery bow, variations in the alignment between the limbs and the handle due to manufacturing tolerances or the preferences of an archer are accommodated with a laterally adjustable limb pocket having an elongated feature extending across the pocket. The feature permits at least a portion of the pocket to move from side to side on the handle. The feature is a ridge having a dovetail cross-section for engaging a dovetail slot in the end of the handle. Alternatively, the feature is a hole elongated in a side to side direction across the pocket. The hole receives an internally threaded bushing for locating the pocket while permitting rotation of the pocket about a pivot. For a pair of holes elongated in a side to side direction, the position of the pocket relative to the handle is controlled either by opposed setscrews or by an adjustment screw threaded into the handle.

9 Claims, 3 Drawing Sheets

ARCHERY BOW WITH LATERALLY ADJUSTABLE LIMB POCKET

BACKGROUND OF THE INVENTION

This invention relates to archery bows and, in particular, to a laterally adjustable limb pocket for an archery bow.

Whether hunting or target shooting, an archer strives to develop a consistent form to achieve accuracy with each shot. Seen from above, an archer holding a bow at full draw forms a triangle. The arrow is one side of the triangle, extending from the archer's hand (or release mechanism) to the arrow rest, which is attached just above the grip. The archer's arm is the second side of the triangle, extending from the grip to the archer's shoulder, and the archer's torso is the third side of the triangle. The angle between the arm of the archer and the arrow depends on the archer's style, the draw length of the bow, and the size of the archer. Preferably, the centerline of the handle and the arrow lie in the plane of the drawn bowstring.

A modern archery bow is typically made in three sections: a central handle or riser and two separate limbs. The handle is typically made from alloys of aluminum or magnesium and a separate wood or plastic grip is attached at approximately the middle of the handle. At each end of the handle is a limb pocket, which can be part of the handle or a separate component. The butt end of a limb fits within the limb pocket, which surrounds the end of the limb on three sides and holds the limb in position relative to the handle. Preferably, the centerlines of the limbs are also in the plane of the drawn bowstring.

The components of a bow, while approximately the same from bow to bow, actually vary in size due to manufacturing tolerances. The variations can additively combine or cancel out. If, for example, the variations happen to additively combine, then the centerlines of the limbs may not be coplanar. For some applications, the misalignment may not be a problem. For competitive target shooting, one wants a bow as well aligned as possible for the most consistent possible shooting.

In addition to compensating for manufacturing tolerances, it has been found that moving the limbs laterally relative to the handle can be beneficial since the handle can be held rotated slightly even when the bow is drawn. In this configuration, the sides of the handle are not parallel to the plane of the drawn bow string or to the arrow. This can improve the archer's grip, permitting him to hold the bow while keeping his wrist straight, thereby improving the consistency of his shooting. Finally, since there are many conflicting theories on the proper set up for a bow, some archers obtain more consistent results with bows having seemingly unconventional alignments.

A "compound" bow includes wheels or pulleys attached at the free ends of the limbs to obtain a mechanical advantage in bending the bow. Because of the stiff limbs used in a compound bow, the forces on the handle can be considerable. The forces are further increased if the wheels are eccentrically mounted or cam shaped, which enables one to use a much higher maximum draw weight. The force of the bowstring acting on the end of a limb may not align with the centerline of the handle, e.g. because of the way the bowstring is wound on the wheels or because of a sideward force from using a finger release or a sideward force due to a cable guard pushing to one side the cable portions of the bowstring. The result is a force tending to move the limb from side to side as the bow is drawn and fired by an archer. Thus, the limb attachment must be substantial enough to resist these forces for the bow to perform consistently. An adjustable limb pocket must not go out of adjustment when the bow is drawn and fired.

In view of the foregoing, it is therefore an object of the invention to provide a laterally adjustable limb pocket for an archery bow.

A further object of the invention is to provide a limb pocket which rotates in a plane orthogonal to the plane of a drawn bowstring.

Another object of the invention is to provide a limb pocket which translates, i.e. moves from side to side without rotation, in a plane orthogonal to the plane of a drawn bowstring.

A further object of the invention is to provide a limb pocket which can be adjusted even when a bow is strung, i.e. the pocket is under load.

Another object of the invention is to provide a bow which can be held with the sides of the bow handle not parallel to the plane of the drawn bowstring.

Another object of the invention is to provide an adjustable limb pocket which does not go out of adjustment when the bow is drawn and fired.

SUMMARY OF THE INVENTION

The foregoing objects are achieved by a laterally adjustable limb pocket having an elongated feature extending across the pocket, the feature permitting at least a portion of the pocket to move from side to side on the handle of a bow, whereby the lateral position of each limb can be adjusted relative to the handle or to the plane of a drawn bowstring. In accordance with one aspect of the invention, the feature is a ridge having a dovetail cross-section for engaging a dovetail slot in the end of a handle. In accordance with another aspect of the invention, the feature is a hole elongated in a side to side direction across the pocket. In one embodiment, the hole receives an internally threaded bushing for locating the pocket while permitting rotation of the pocket about a pivot. In another embodiment, a pair of holes are elongated in a side to side direction across the pocket and the position of the pocket relative to the handle is controlled either by setscrews engaging the handle or by washers on an adjustment screw engaging the handle.

BRIEF DESCRIPTION OF THE DRAWINGS

A more complete understanding of the invention can be obtained by considering the following detailed description in conjunction with the accompanying drawings in which.

DETAILED DESCRIPTION OF THE INVENTION

Figure 1:
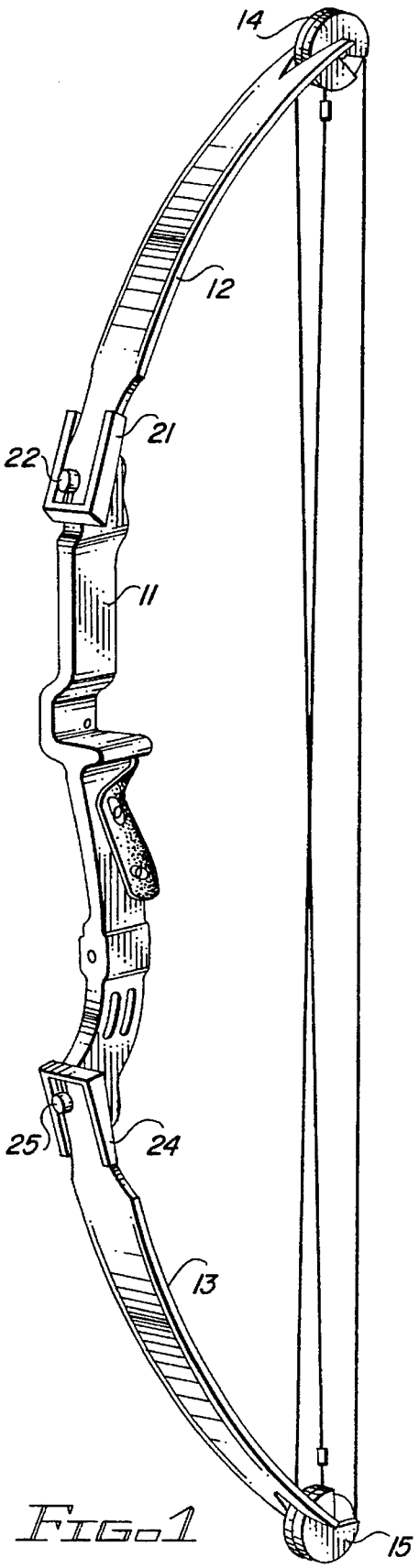
FIG. 1 illustrates a compound bow having limb pockets which are separate from the handle of the bow.

FIG. 1 illustrates a preferred embodiment of a compound bow incorporating the teachings of the invention, which can also be applied to recurve bows. Bow 10 includes handle 11 having opposite ends thereof attached to the butt ends of upper limb 12 and lower limb 13. Wheels 14 and 15 are attached to the free ends of limbs 12 and 13, respectively, and are laced with bowstring 17 in a manner well known in the art.

Upper limb 12 is attached to handle 11 by limb pocket 21. Limb bolt 22 extends through the butt end of limb 12 and through limb pocket 21 to engage a threaded hole near the upper end of handle 11. Lower limb 13 is attached to handle 11 by limb pocket 24. Limb bolt 25 extends through the butt end of limb 13 and through limb pocket 24 to engage a threaded hole near the lower end of handle 11.

Figure 2:
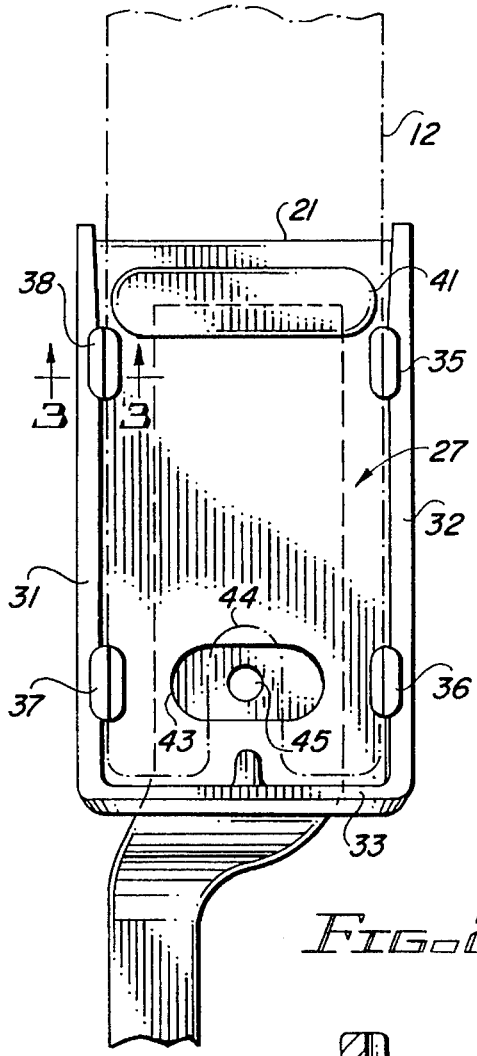
FIG. 2 is a top view of a laterally adjustable limb pocket constructed in accordance with the invention.
Figure 4:
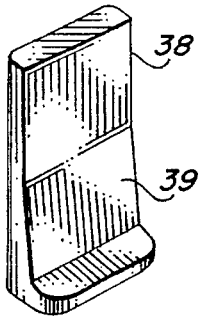
FIG. 4 illustrates an insert for resiliently confining the butt end of a limb in a limb pocket.
Figure 3:
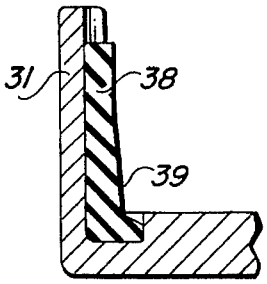
FIG. 3 is a cross-section along line 3—3 in FIG. 2.

FIG. 2 illustrates in greater detail how a limb is attached to a handle in accordance with the invention. Limb pocket 21 includes chamber 27 formed by side wall 31 and side wall 32 interconnected by end wall 33. Limb 12 fits closely within chamber 27 and frictionally engages tab 35 and tab 36 in side wall 32 and tab 37 and tab 38 in side wall 31. As illustrated in FIG. 3, the tabs are located in recesses formed within the side walls and in the floor of chamber 27. As shown in FIGS. 3 and 4, tab 38 includes thicker, lower portion 39 for frictionally engaging the butt end of limb 12 as it rests in chamber 27. Limb 12 is also separated from the floor of chamber 27 by pivot 41 (FIG. 2). Tabs 35–38 and pivot 41 are made from a hard plastic and prevent limb 12 from rattling against limb pocket 21 as the bow is drawn and fired.

Near the inner end of chamber 27, hole 43 is elongated in a side to side direction across pocket 21. This provides clearance for limb bolt 22 (FIG. 1) to pass through hole 43 as pocket 21 is moved laterally, i.e. from left to right as pocket 21 is illustrated in FIG. 2. The limb bolt passes through elongated hole 43 and split 44 in the end of limb 12 to engage threaded hole 45 in handle 11.

Figure 5:
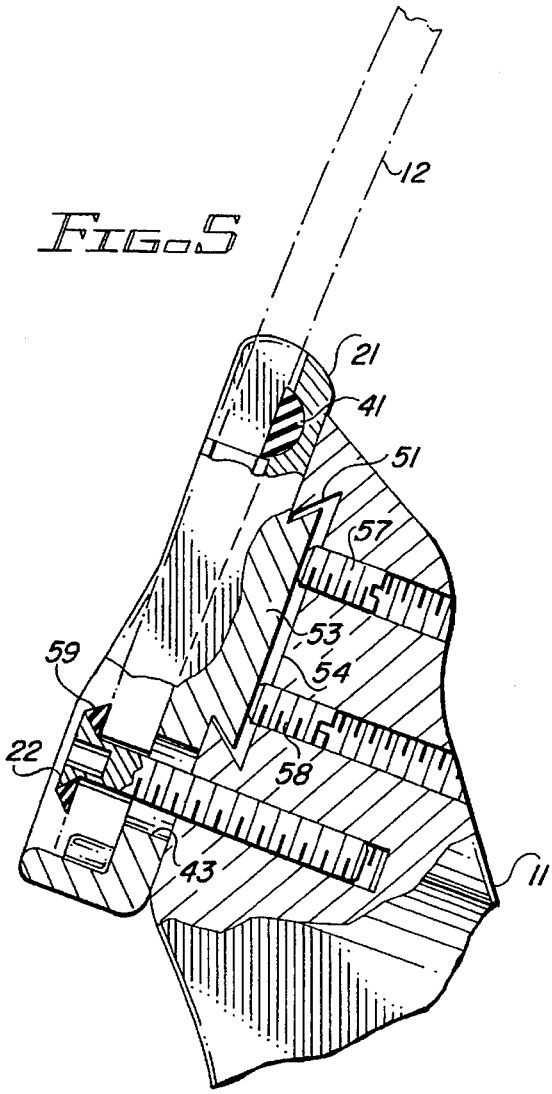
FIG. 5 is a cross-sectional view of a laterally adjustable limb pocket constructed in accordance with the invention.
Figure 6:
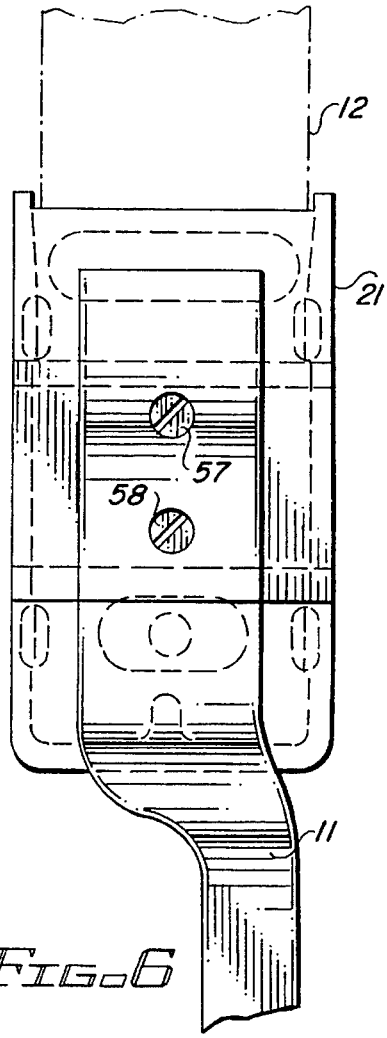
FIG. 6 is a bottom view of the laterally adjustable limb pocket shown in FIG. 2.

FIGS. 5 and 6 illustrate in greater detail the attachment of pocket 21 to limb 11. Pocket 21 is characterized by an elongated feature extending across the pocket for permitting pocket 21 to move in a plane orthogonal to the plane of a drawn bowstring. As illustrated in FIGS. 5 and 6, this feature is dovetail joint 51. The underside of pocket 21 includes ridge 53 extending transversely and having a dovetail shaped cross-section. The upper end of handle 11 includes transverse slot 54, also having a dovetail cross-section. As known to those of skill in the art of joinery, a dovetail joint can be made extremely tight fitting, wherein the angles and lengths of the sides of the joint match exactly, or somewhat more loosely fitting, wherein the angles and lengths of the sides of the dovetail are slightly different from the angle and lengths of the sides of the slot.

In a preferred embodiment of the invention, the dovetail joint is somewhat loose to facilitate the transverse motion of pocket 21. Setscrews 57 and 58 are provided for jamming the dovetail against the sides of slot 54. When setscrews 57 and 58 are tightened, pocket 21 cannot move relative to handle 11. Thus, pocket 21 is securely attached to handle 11. Limb bolt 22 passes through washer 59, limb 12, hole 43 and engages handle 11, thereby attaching limb 12 to handle 12.

The lateral adjustment obtainable from pocket 21 is equal to the difference in widths between pocket 21 and the end portion of handle 11. In theory, one could move pocket 21 sideways a sufficient distance to expose a portion of slot 54 within handle 11. It is preferred that dovetail 53 fully engage the entire width of handle 11. This provides the greatest area of contact between pocket 21 and handle 11 and therefore provides the greatest strength for the joint. It is understood by those of skill in the art that the dovetail joint could be reversed, i.e. a ridge on handle 11 and a slot in the underside of pocket 21. Also, while illustrated as including a single dovetail, it is understood that more than one dovetail can be used, depending upon the strength of the metals used for pocket 21 and handle 11. In one embodiment of the invention, using a handle made from aluminum alloy, dovetail joint 51 had a depth of 0.375 inches.

Figure 7:
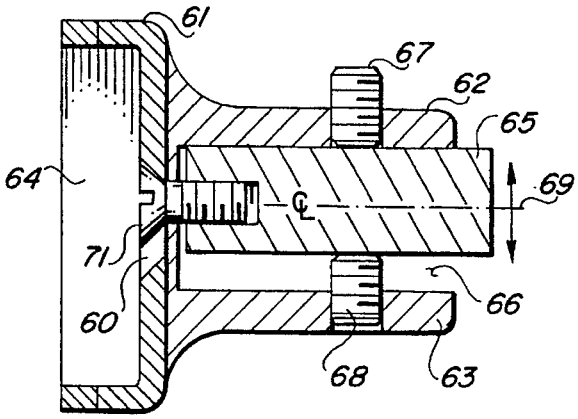
FIG. 7 illustrates an adjustment mechanism for a laterally adjustable limb pocket constructed in accordance with the invention.

In order to resist flexing, handle 11 is wider in the plane of a drawn bowstring than it is orthogonal to that plane, i.e. handle 11 is wider front to rear than it is from side to side. This shape is conveniently used to advantage by having limb pockets 21 and 24 straddle the ends of handle 11 with walls extending from the underside of the pockets. FIG. 7 illustrates an alternative embodiment of the invention in which pocket 61 includes lower walls 62 and 63 extending from the underside of the floor of chamber 64. Lower wall 62 is separated from lower wall 63 by a distance greater than the thickness of handle 65, leaving gap 66. Pocket 61 can move from side to side relative to handle 65 and is held in place by opposed setscrews 67 and 68 abutting the handle. Adjusting the setscrews moves centerline 69 of pocket 61 relative to the centerline of handle 65. Pocket 61 is attached to handle 65 by screw 71 passing through elongated hole 60 in the floor of chamber 64. Setscrews 67 and 68 can engage optional recesses 72 and 73 for holding pocket 61 in place on handle 65.

Figure 8:
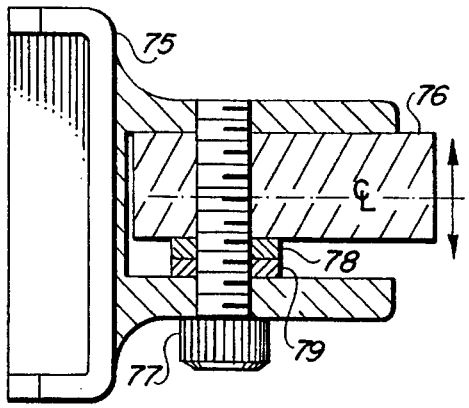
FIG. 8 illustrates another adjustment mechanism for a laterally adjustable limb pocket constructed in accordance with the invention.

FIG. 8 illustrates another alternative embodiment of the invention in which adjustment screw 77 passes through a clear (unthreaded) hole in the the lower walls, washers 78 and 79, and engages a threaded hole in handle 76. The location of washers 78 and 79 on either side of handle 76 determines the side to side position of pocket 75 relative to the handle. Unlike the embodiment of FIG. 7, which is continuously adjustable, the embodiment of FIG. 8 is incrementally adjustable. The number and thickness of the washers can be changed to suit the desired range of adjustment and the number of steps within that range.

Figure 9:
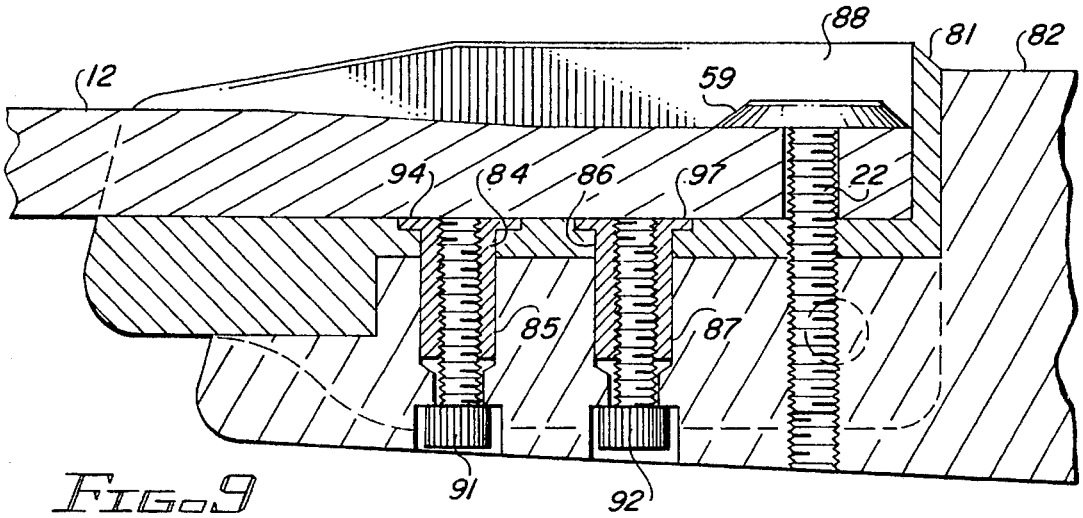
FIG. 9 is a cross-sectional view of a laterally adjustable limb pocket constructed in accordance with an alternative embodiment of the invention.
Figure 10:
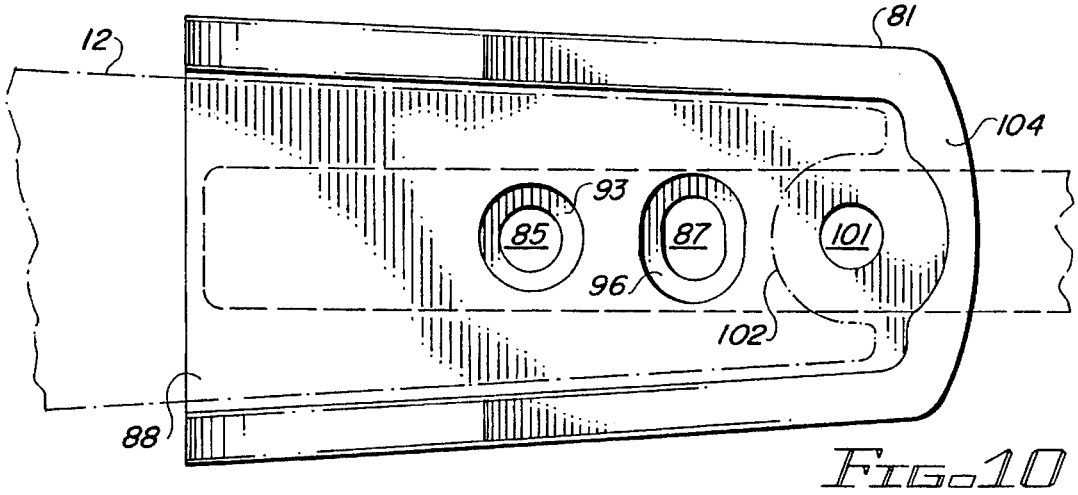
FIG. 10 is a top view of the limb pocket illustrated in FIG. 9.
Figure 11:
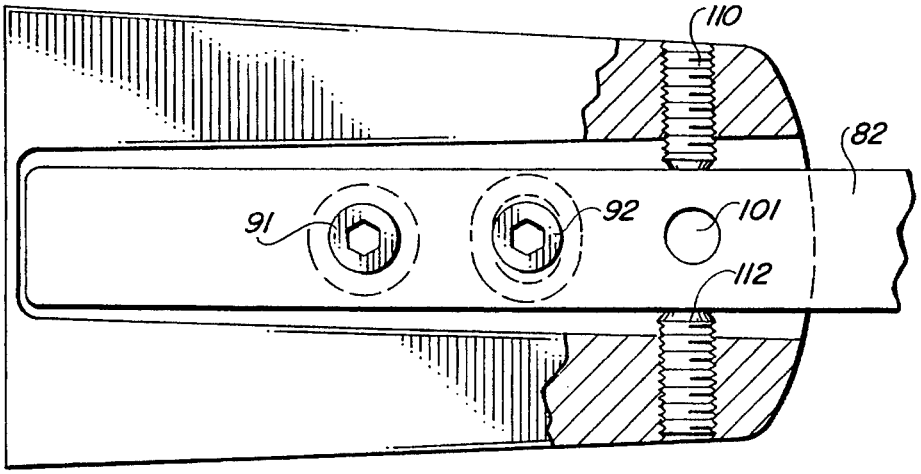
FIG. 11 is a bottom view of the limb pocket illustrated in FIG. 9.

FIGS. 9–11 illustrates a laterally adjustable pocket constructed in accordance with another aspect of the invention. In the embodiment shown in FIG. 5, the pocket moves without rotation, i.e. the pocket translates in a plane orthogonal to the plane of a drawn bowstring. In the embodiment illustrated in FIGS. 9–11, the pocket rotates in a plane orthogonal to the plane of a drawn bowstring. Pocket 81 is attached to handle 82 by internally threaded bushing 84 in counterbore 85 and internally threaded bushing 86 in counterbore 87. Counterbore 85 includes shoulder 93 at the upper end thereof for engaging flange 94 on bushing 84. Counterbore 87 is elongated in a direction from side to side across pocket 81 and includes shoulder 96 for engaging flange 97 on bushing 86. Pocket bolt 91 passes through handle 82 to engage bushing 84 from the end opposite flange 94. Pocket bolt 92 passes through handle 82 to engage bushing 86 from the end opposite flange 97. The butt end of limb 12 rests within chamber 88 and is attached to handle 82 by limb bolt 22.

Bushing 86 can slide from side to side across pocket 81. Counterbore 85 is circular and permits only a rotational motion of pocket 81 about bushing 84 as a pivot, causing the free end of limb 12 to describe an arc whose length is proportional to the ratio of the distance from the free end of limb 12 to counterbore 85 and the center to center distance between counterbores 85 and 87.

Threaded bore 101 (FIG. 11) receives limb bolt 22. Slot 102 (FIG. 10) in the end of limb 12 is wider than limb bolt 22, permitting limb 12 to rotate with pocket 81. End wall 104 of pocket 81 includes recess 105 to provide clearance for washer 59 (FIG. 9).

Pocket 81 can be adjusted by hand but is preferably controlled by a pair of opposed setscrews, as illustrated in FIG. 11, for providing a precise, continuous adjustment of the amount that pocket 81 is rotated. Opposed setscrews 110 and 112 engage threaded holes in the lower walls extending from pocket 81. By suitable adjustment of setscrews 110 and 112, the archer is able to precisely adjust the rotational position of pocket 81 either to assure that the center lines of the limbs are in the plane of the drawn bowstring or to provide a preferred offset to accommodate the shooting style of the archer.

Having thus described the invention it will be apparent to those of skill in the art that various modifications can be made within the scope of the invention. For example, pivot bushing 84 can be eliminated and the limb bolt used as the pivot point for the adjustable pocket. Bushing 84 can be replaced by a short pin extending from the underside of pocket 81 into a small, blind hole in handle 82. The positions of holes 85 and 87 can be reversed. The adjustment mechanism shown in FIG. 8 can be used for the embodiment shown in FIG. 9. Because of the stresses produced in the handle by drawing and firing a bow, the dovetail joint illustrated in FIG. 5 is preferred because of the distribution of stresses by the joint. However, other types of joints can be used instead such as a "T" shaped slot and a correspondingly shaped ridge on pocket 21.

I claim:

1. An archery bow comprising:

a handle having two ends;

a pair of limbs each having a butt end for attachment to said handle and a free end;

a bowstring interconnecting the free ends of said limbs;

a pair of limb pockets interconnecting the ends of the handle and the butt ends of said limbs;

a pair of limb bolts for attaching said limbs and said pockets to said handle;

wherein each limb pocket has an elongated feature extending across said pocket, said feature permitting at least a portion of said pocket to move from side to side on said handle whereby each limb can be positioned laterally on said handle.

2. The archery bow as set forth in claim 1 wherein said feature is a dovetail joint between the limb pocket and the end of said handle.

3. The archery bow as set forth in claim 2 and further including setscrews engaging said dovetail joint for locking said dovetail joint.

4. The archery bow as set forth in claim 1 wherein each limb pocket defines a chamber having opposed side walls, an end wall, and a floor and wherein said feature is a hole in said floor, said hole being elongated in a direction parallel with said end wall.

5. The bow as set forth in claim 4 and further including a pair of internally threaded bushings and a pair of pocket bolts, wherein said internally threaded bushings engage said elongated holes and said pocket bolts engage said bushings.

6. The bow as set forth in claim 5 wherein each of said elongated holes includes a shoulder, each of said bushings have a first end and a second end and a flange at said first end, and wherein said flanges engage said shoulders and the pocket bolt engages the second end of the bushing.

7. The bow as set forth in claim 4 wherein said limb bolts engage said elongated holes.

8. The bow as set forth in claim 7 wherein each limb pocket includes a pair of setscrews;

a pair of lower walls extending away from said chamber and straddling said handle, each lower wall containing a threaded hole for receiving one of said setscrews, said setscrews extending through said threaded holes and abutting said handle.

9. The bow as set forth in claim 7 wherein said handle includes a threaded hole extending from side to side at each end of said handle and each limb pocket includes a pair of lower walls extending away from said chamber and straddling said handle, at least one lower wall including a clear hole, and an adjustment screw passing through said clear hole and engaging said threaded hole at the end of said handle.

* * * * *